US006050499A

United States Patent [19]

Takayama et al.

[11] Patent Number: 6,050,499

[45] Date of Patent: Apr. 18, 2000

[54] ROTARY SPRAY HEAD COATER

[75] Inventors: Shinichi Takayama; Masatoshi Kon; Shogo Ikeda, all of Tokyo, Japan

[73] Assignee: ABB K. K., Tokyo, Japan

[21] Appl. No.: 09/117,451

[22] PCT Filed: Dec. 2, 1997

[86] PCT No.: PCT/JP97/04405

§ 371 Date: Aug. 3, 1998

§ 102(e) Date: Aug. 3, 1998

[87] PCT Pub. No.: WO98/24554

PCT Pub. Date: Jun. 11, 1998

[30] Foreign Application Priority Data

Dec. 3, 1996 [JP] Japan ..... 8-337611

[51] Int. Cl.[7] ..... B05B 15/02; B05B 3/10

[52] U.S. Cl. ..... 239/112; 239/105; 239/106; 239/223; 239/224; 239/293; 239/296; 239/700; 239/703; 239/705

[58] Field of Search ..... 239/104, 105, 239/106, 112, 223, 224, 290, 293, 296, 298, 690, 700, 701, 702, 703, 704, 705

[56] References Cited

U.S. PATENT DOCUMENTS

| | | | |
|---|---|---|---|
| 4,572,437 | 2/1986 | Huber et al. | 239/296 X |
| 5,106,025 | 4/1992 | Giroux et al. | 239/703 |
| 5,707,009 | 1/1998 | Schneider | 239/112 |
| 5,813,608 | 9/1998 | Yoshioka et al. | 239/112 X |
| 5,862,988 | 1/1999 | Van Der Steur | 239/224 X |
| 5,894,993 | 4/1999 | Takayama et al. | 239/112 |

FOREIGN PATENT DOCUMENTS

| | | | |
|---|---|---|---|
| 715896 | 6/1996 | European Pat. Off. . | |
| 3912700 | 10/1990 | Germany | 239/112 |
| 57-62659 | 4/1982 | Japan . | |
| 2-503647 | 11/1990 | Japan . | |
| 3-151071 | 6/1991 | Japan . | |
| 8-155349 | 6/1996 | Japan . | |
| 8-332415 | 12/1996 | Japan . | |
| 9-285742 | 11/1997 | Japan . | |
| 88/10153 | 12/1988 | WIPO . | |

*Primary Examiner*—Lesley D. Morris
*Assistant Examiner*—Robin O. Evans
*Attorney, Agent, or Firm*—Oblon, Spivak, McClelland, Maier & Neustadt, P.C.

[57] ABSTRACT

A rotary atomizing head type coating machine which is capable of washing deposited paint from fore end portions of outer peripheral surface of a bell cup. Thinner passages are provided on the bell cup to communicate a paint reservoir with the outer peripheral surface of the bell cup. Thinner which flows out onto the outer peripheral surface of the bell cup through the thinner passages is guided toward the marginal releasing edge of the bell cup. To this end, assist air is spurted out through assist air outlet holes which are provided in the fore end face of a shaping air ring at positions radially on the inner side of shaping air outlet holes. Accordingly, at the time of a washing operation, the thinner which has come out onto the outer peripheral surface of the bell cup is forcibly pushed on the outer peripheral surface by the actions of assist air and shaping air as the thinner is guided toward the fore end of the bell cup to wash away deposited paint therefrom.

15 Claims, 12 Drawing Sheets

ROTARY SPRAY HEAD COATER

BACKGROUND OF THE INVENTION

1. Field of the Invention

This invention relates to a rotary atomizing head type coating machine particularly suitable for use in paint coating operations involving color changes.

2. Discussion of the Background

Generally, rotary atomizing head type coating machines are largely constituted by: a cover which is formed in a cylindrical shape; an air motor which is provided within the cover; a rotational shaft which is provided axially in and rotated by the air motor; a rotary atomizing head which is mounted axially in the rotational shaft and put in high-speed rotation by the rotational shaft; and a feed tube provided axially in the rotational shaft, and having a fore end extended into the rotary atomizing head for spouting thereinto a paint or a thinner as a solvent.

In turn, the above-mentioned rotary atomizing head is constituted by: a bell cup which is formed in a bell- or cup-like shape; a hub member which is located on the inner peripheral side of the bell cup and defines thereon a paint reservoir for holding a pool of paint supplied through the paint feed tube; a plural number of paint outlet holes provided on the outer peripheral side of the hub member to permit the paint supplied through the feed tube to flow out from the paint reservoir toward marginal releasing edge at the fore end of inner peripheral surface of the bell cup; and a plural number of solvent outlet holes provided in center portion of the hub member to permit the thinner supplied through the feed tube to flow out from the paint reservoir toward the front side of the hub member.

The above-mentioned feed tube is connected to a color changing valve device which supply paint, air and thinner through a paint supply pipe. Further, the coating machine is connected to a high voltage generator to apply negative high voltage in electrostatic coating operations.

With a conventional rotary atomizing head type coating machine which is arranged in this manner, a coating operation is started firstly by supplying compressed air to the air motor to put the rotary atomizing head in high speed rotation together with the rotational shaft. In the next place, a paint is spouted out from the feed tube into the paint reservoir which is provided on the rotary atomizing head. As a result, the paint is urged to flow along inner peripheral surface of the bell cup and, after being spread into a thin film, sprayed as charged paint particles from the marginal releasing edge at the fore end of the bell cup. At this time, the change paint particles, which are released from at marginal edge of the rotary atomizing head, are urged to fly toward a coating object along lines of electric force of an electrostatic field which is formed between the coating object, and to deposit on the coating object.

Further, it becomes necessary to change the paint color, air and thinner are supplied to the rotary atomizing head from the color changing valve device, thereby washing away the previous color which has deposited on liquid-contacting surfaces of the rotary atomizing head. Then, a paint of a different color is supplied to the paint supply passage in preparation for a coating operation with a new color.

However, at the time of supplying paint of a fresh color as described above, it is often the case that the new color deposits on front surface of the hub member as well as on outer peripheral surface of the bell cup. Besides, the paint which has deposited on the rotary atomizing head undergoes solidification while a coating line is stopped for a certain time period due to a trouble on the line or for a lunch-time break. Similarly, paint deposition and accumulation takes place when a paint of same color is used for hours.

In such a case, it becomes necessary to wash solidified paint deposits off the liquid-contacting surfaces of the rotary atomizing head since otherwise defoliated fragments of solidified paint will make coating defects.

In this regard, in order to wash deposited paint off the rotary atomizing head, while the rotational shaft and rotary atomizing head are rotated by the air motor, thinner is spurted out from the feed tube into the paint reservoir on the rotary atomizing head, separately from air and thinner which is supplied from the color changing valve device. By so doing, a part of the thinner is supplied to the marginal releasing edge through the paint outlet holes from the paint reservoir to wash away the deposited paint at the marginal releasing edge. Also, a part of the thinner is supplied onto front surface of the hub member through the solvent outlet holes to wash away deposited paint from front surface of the hub member.

In a coating operation with a conventional paint coating machine of this sort, paint particles which are sprayed from marginal releasing edge of the bell cup are applied with a high voltage by a high voltage generator, and most of the charged paint particles are urged to fly along an electrostatic field toward a coating object which is connected to the earth. However, there is often a case that a part of the released paint particles tend to flow in an inverse direction toward the rear side of the bell cup, and to deposit on fore end portions of outer peripheral surface of the bell cup.

Namely, when the rotary atomizing head is put in high speed rotation, vacuum pressure regions occur on the front side of the bell cup under the influence of the high speed rotation, and a part of paint particles are sucked into the vacuum regions by the so-called pumping phenomenon and caused to flow in a reversed direction toward the rear side of the bell cup.

In addition, for the purpose of shaping the spray of paint particles into a suitable pattern depending upon the conditions of coating operation, shaping air is spurted toward the outer peripheral side of the rotary atomizing head from shaping air outlets which are located at the front end of the cover. Due to the jet streams of shaping air, vacuum pressures are developed partially around the outer peripheral side of the bell cup, and as a result, a part of paint particles are caused to flow inversely toward the rear side of the bell cup.

If paint particles are partly entrained on inverse air flows in this manner, they deposit on outer peripheral surface of the bell cup and remain there in a solidified state. Therefore, under certain conditions of coating operation, solidified paint falls off in small fragments which can detrimentally impair the quality of end products by depositing on coated surfaces.

Further, according to the prior art coating machine, the marginal releasing edge of the bell cup and front surface of the hub member are washed with a thinner which is spurted out toward the inner peripheral surface of the bell cup from the afore-mentioned feed tube. However, difficulties are often experienced in removing deposited paint from the outer peripheral surface of the bell cup simply by supplying a thinner through a feed tube in such a manner.

In this connection, in an attempt to overcome the problem just mentioned, Japanese Utility Model Laid Open No. S57-62659 (hereinafter referred to as "other prior art" for brevity) discloses a coating machine employing a washing nozzle which is arranged to spurt a thinner toward the outer peripheral surface of a bell cup for washing away deposited paint therefrom.

According to the coating machine by the other prior art just mentioned, at the time of washing the outer peripheral side of a bell cup, a thinner is simply spurted toward outer peripheral surface of the bell cup while the rotary atomizing head is being kept in rotation. Therefore, the thinner is splashed back on outer peripheral surface of the bell cup instead of being brought into intimate contact with the outer peripheral surface thereof, there by often failing to washing away deposited paint from fore end portions of outer peripheral surface of the bell cup in an assured manner.

In order to wash away deposited paint from outer peripheral surface of the bell cup in a more reliable manner, free of the above-mentioned problems of the thinner being splashed back without contacting outer peripheral surface of the bell cup to a sufficient degree, it is necessary to determine the position and direction of a washing nozzle precisely and elaborately in relation with a thinner feed rate through engineering processes which require extremely sophisticated machine designing and production technology.

Further, considering complications in construction and increases in the number of machine parts and production cost, it is inefficient and uneconomical to provide a washer nozzle exclusively for the purpose of washing outer peripheral surface of a bell cup in addition to a feed tube which is fitted in rotational shaft of the rotary atomizing head for spurting a thinner toward inner peripheral surface of the bell cup as in the above-described prior art coating machine.

SUMMARY OF THE INVENTION

In view of the problems of the prior art as described above, it is an object of the present invention to provide a rotary atomizing head type coating machine which can wash away deposited paint from outer peripheral surface of a bell cup in an assured manner by letting a solvent which is spouted from a feed tube, flow out onto outer peripheral surface of the bell cup through a number of solvent outlet passages provided on the bell cup.

It is another object of the present invention to provide a rotary atomizing head type coating machine which is arranged to guide a solvent which has flown out onto outer peripheral surface of a bell cup, toward fore end portions of the bell cup by the use of assist air which is supplied from front end portions of a cover.

It is still another object of the present invention to provide a rotary atomizing head type coating machine which, when a solvent is spouted into a paint reservoir from a feed tube at the time of washing the rotary atomizing head, can feed the solvent into solvent outlet passages of a bell cup in an assured and reliable manner.

The rotary atomizing head type coating machine according to the present invention basically includes a cover formed in a cylindrical shape, an air motor provided within the cover, a rotational shaft provided axially in and rotated by the air motor, a rotary atomizing head mounted on the rotational shaft for high speed rotation therewith, and a feed tube provided axially in the rotational shaft and having a fore end portion extended into the rotary atomizing head for spouting paint or solvent thereinto.

In accordance with the present invention, for solving the above-mentioned problems, the rotary atomizing head is constituted by a bell cup generally of a bell- or cup-like shape, a hub member mounted on the inner peripheral side of the bell cup and defining a paint reservoir on and together with the bell cup for temporarily storing paint spouted through the feed tube, a plural number of paint outlet holes provided in the hub member to let paint or solvent supplied to the paint reservoir from the feed tube flow out from the paint reservoir onto fore inner peripheral surface of the bell cup, and a plural number of solvent passages provided in the bell cup to let a solvent supplied to the paint reservoir through the feed tube flow out from the paint reservoir onto outer peripheral side of the bell cup; and assist air outlet holes are provided in front end portions of the cover to spurt assist air for guiding the solvent toward the front end of the bell cup upon coming out onto outer peripheral side of the bell cup through the solvent passages.

With the arrangements just described, the rotary atomizing head is put in high speed rotation together with the rotational shaft at the time of a coating operation, feeding paint to the paint reservoir through the feed tube. Whereupon, the paint which has been spouted into the paint reservoir is diffused within the paint reservoir under the influence of centrifugal force and urged to flow out therefrom through the paint outlet holes in the hub member and to run along the inner peripheral surface of the bell cup toward the fore end thereof. After being spread into a thin film, the paint is released in the form of atomized paint particles at marginal edges at the front end of the inner peripheral surface of the bell cup. The atomized paint particles are caused to fly toward a coating object for deposition thereon.

When it becomes necessary to change the paint color, a next color is supplied to and filled in paint supply passages after washing away deposited previous color from the feed tube and rotary atomizing head with the use of air and solvent.

In case it becomes necessary to feed a next color after a temporary suspension of a coating operation, paint which has deposited on the rotary atomizing head is washed away by spouting a solvent into the paint reservoir through the feed tube separately from the supply of above-mentioned air and solvent, while putting the rotary atomizing head in rotation. A part of the solvent supplied to the paint reservoir is urged to flow out through the paint outlet holes in the hub member toward fore end portions of the inner peripheral surface of the bell cup to wash away deposited paint therefrom.

On the other hand, a part of the solvent which has been supplied to the paint reservoir is allowed to enter the respective solvent passages in the bell cup and flow out onto the outer peripheral side of the bell cup through the solvent passages. Thus, through the respective solvent passages, a part of the solvent is allowed to flow out onto the outer peripheral surface of the bell cup for washing the same.

An assist air is spurted out through the assist air outlet holes. Therefore, the solvent which flows out through the respective solvent passage, tends to scatter away in radially outward directions under the influence of centrifugal force resulting high speed rotation of the rotary atomizing head. However, the solvent is forcibly pushed against the outer peripheral surface of the bell cup by the actions of the assist air which is spurted out from the assist air outlet holes. As a result, the solvent is guided toward the front end of the bell cup, thereby washing away the deposited paints from the end portion of the outer peripheral surface of the bell cup.

Further, according to the present invention, shaping air outlet holes are provided in front end portions of the cover radially on the outer side of the assist air outlet holes.

With the arrangement just described, the solvent within the bell cup is urged to flow out onto the outer peripheral side of the bell cup through the respective solvent passages. The solvent flowing out onto the outer peripheral surface of the bell cup in this manner is forcibly pushed against the outer peripheral surface by the actions of assist air which is spurted out through the respective assist air outlet holes and of shaping air which is spurted out through the respective shaping air outlet holes against the centrifugal force resulting from high speed rotation of the rotary atomizing head. As a result of suppression of scattering of the solvent in the radially outward directions of the bell cup, the solvent can contribute to wash away deposited paint from the outer peripheral surface of the bell cup.

Preferably, according to the present invention, the cover is internally provided with an assist air passage for distribution of assist air supplied from a pressurized air source and an exhaust air passage for distribution of exhaust air from the air motor, in such a way that air from the assist air passage and exhaust air passage are joined together and spurted out jointly through the assist air outlet holes.

With the arrangements just described, air which is supplied from the pressurized air source through the assist air passage is joined with exhaust air which is supplied from the air motor through the exhaust air passage, and jointly spurted out through the respective assist air outlet holes toward the front side of the outer peripheral surface of the bell cup, thereby utilizing exhaust air effectively as assist air and reducing the flow rate of assist air from the compressed air source.

In this regard, according to the present invention, a plug may be detachably attached to the exhaust air passage for the purpose of selectively bringing the exhaust air passage into and out of communication with the assist air passage.

With the arrangements just described, assist air is supplied from the assist air passage alone when the exhaust air passage is stopped by a plug, and assist air is joined with exhaust air from the exhaust air passage when the plug is removed therefrom.

Further, in another preferred form of the present invention, an assist air controlling means is provided between the assist air passage and the pressurized air source for the purpose of controlling the flow rate or pressure of assist air.

With the arrangement just described, either the flow rate or pressure of assist air can be adjusted by the assist air controlling means to a suitable level in pushing the solvent against the outer peripheral surface of the bell cup.

In still another preferred form of the present invention, a flange portion is formed around the fore end of the feed tube for diffused distribution of the solvent spouted through the feed tube.

With the arrangements just described, as soon as a solvent is spouted out through the feed tube at the time of a washing operation, the solvent is diffused by collision against the flange portion, and as a result, a larger amount of the solvent is distributed toward the paint outlet holes in outer peripheral regions of the hub member, thereby contributing to wash away deposited paint from liquid-contacting surfaces and outer peripheral surface of the rotary atomizing head.

In this regard, according to the present invention, the flange portion which is provided around the fore end of the feed tube may be provided with a number of notches at intervals around the circumference thereof.

With the arrangements just described, as soon as a solvent is spouted out through the feed tube at the time of a washing operation, a part of the solvent is allowed to flow in a straightforward direction through the notches in the flange portion while the remainder of the solvent is diffused upon collision against the flange portion. It follows that, by adjusting the size, shape and/or number of the notches, the solvent which is spouted out through the feed tube can be distributed toward the respective paint outlet holes, solvent outlet holes and solvent passages in a suitable ratio.

Further, in another preferred form of the present invention, an annular guide member is provided around the outer peripheral surface of the bell cup in predetermined spaced relation with the bell cup to form therebetween a solvent diffusing chamber in which the effluent solvent from the solvent passages is diffused.

With the arrangements just described, the solvent which is supplied to the paint reservoir during a washing operation of the rotary atomizing head is allowed to flow out onto the outer peripheral side of the bell cup through the solvent passages. Then, the solvent which has been introduced into the solvent diffusing chamber is diffused over the entire periphery of the bell cup within the diffusing chamber before leaving the annular guide. As the solvent flows out of the annular guide in diffused state, it is pushed against the outer peripheral surface of the bell cup by the action of assist air which is spurted out through the assist air outlet holes, to wash away deposited paint of previous color from fore end portions of the outer peripheral surface of the bell cup around the entire periphery thereof.

In this instance, an annular protuberance may be provided within said solvent diffusing chamber thereby to distribute the solvent around the entire outer periphery of said bell cup.

With the arrangements just described, during a washing operation of the rotary atomizing head, the solvent which flows through the solvent diffusing chamber is temporary blocked and diffused around the entire periphery of the diffusing chamber by dam effects of the annular protuberance.

Further, according to the present invention, an annular barrier groove may be provided on the outer peripheral surface of the bell cup for temporarily storing effluent solvent from the solvent passages.

DETAILED DESCRIPTION OF THE PREFERRED EMBODIMENT

Figure 1:
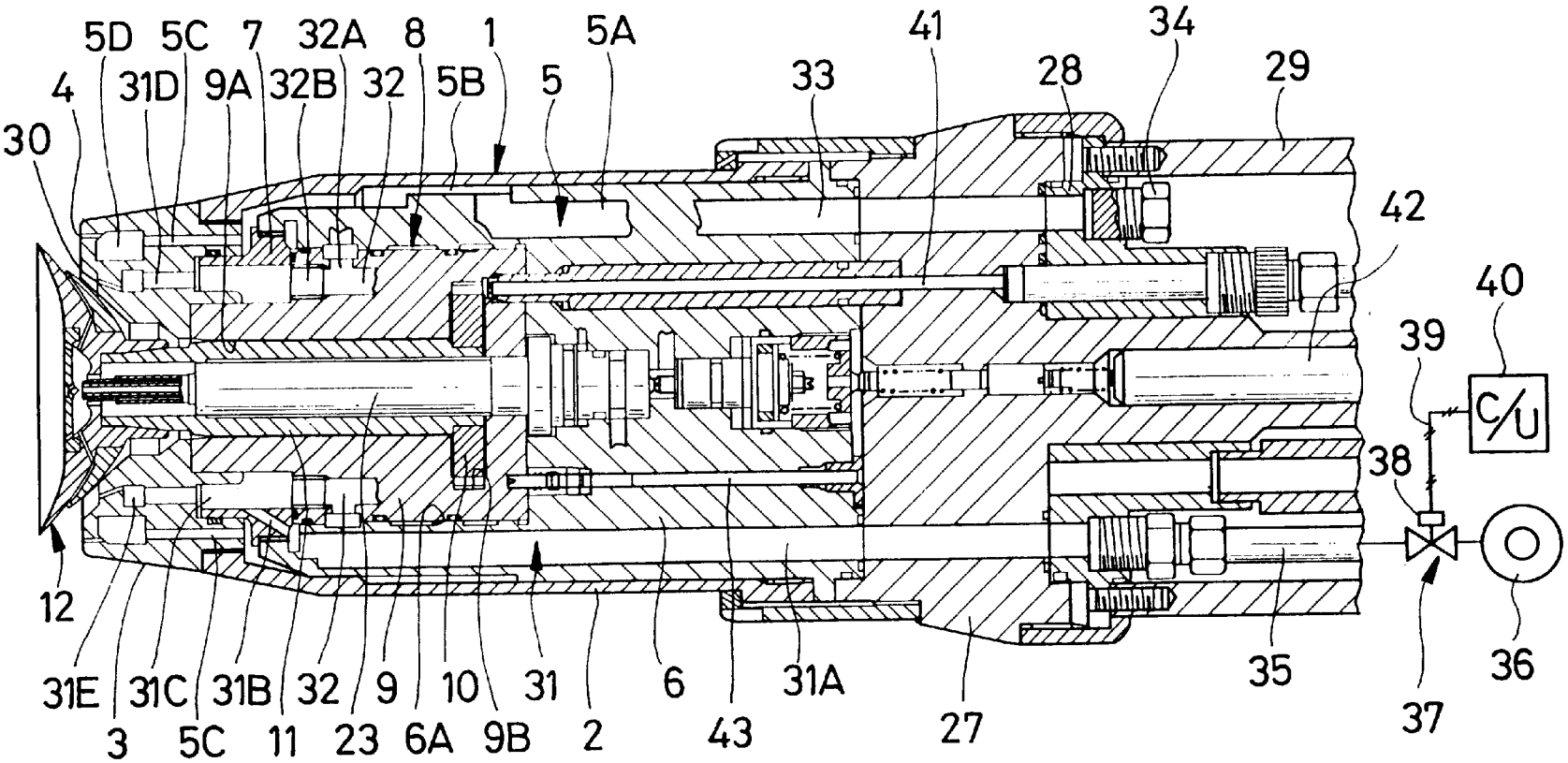
FIG. 1 is a vertical sectional view of a rotary atomizing head type coating machine adopted as a first embodiment of the present invention.

Hereafter, practical forms of the rotary atomizing head type coating machine according to the present invention are described in detail with reference to the accompanying drawings.

Shown in FIGS. 1 through 7 of the accompanying drawings is a first embodiment of the rotary atomizing head type coating machine according to the present invention.

In these figures, indicated at 1 is a cover which determines the outer configuration of the rotary atomizing type coating machine. The cover 1 is largely constituted by a thin-wall cylindrical cover body 2 and a shaping air ring 3 which is provided at the front end of the cover body 2. The cover body 2 accommodates therein a front housing 6 and an air motor 8 which will be described hereinafter.

Figure 2:
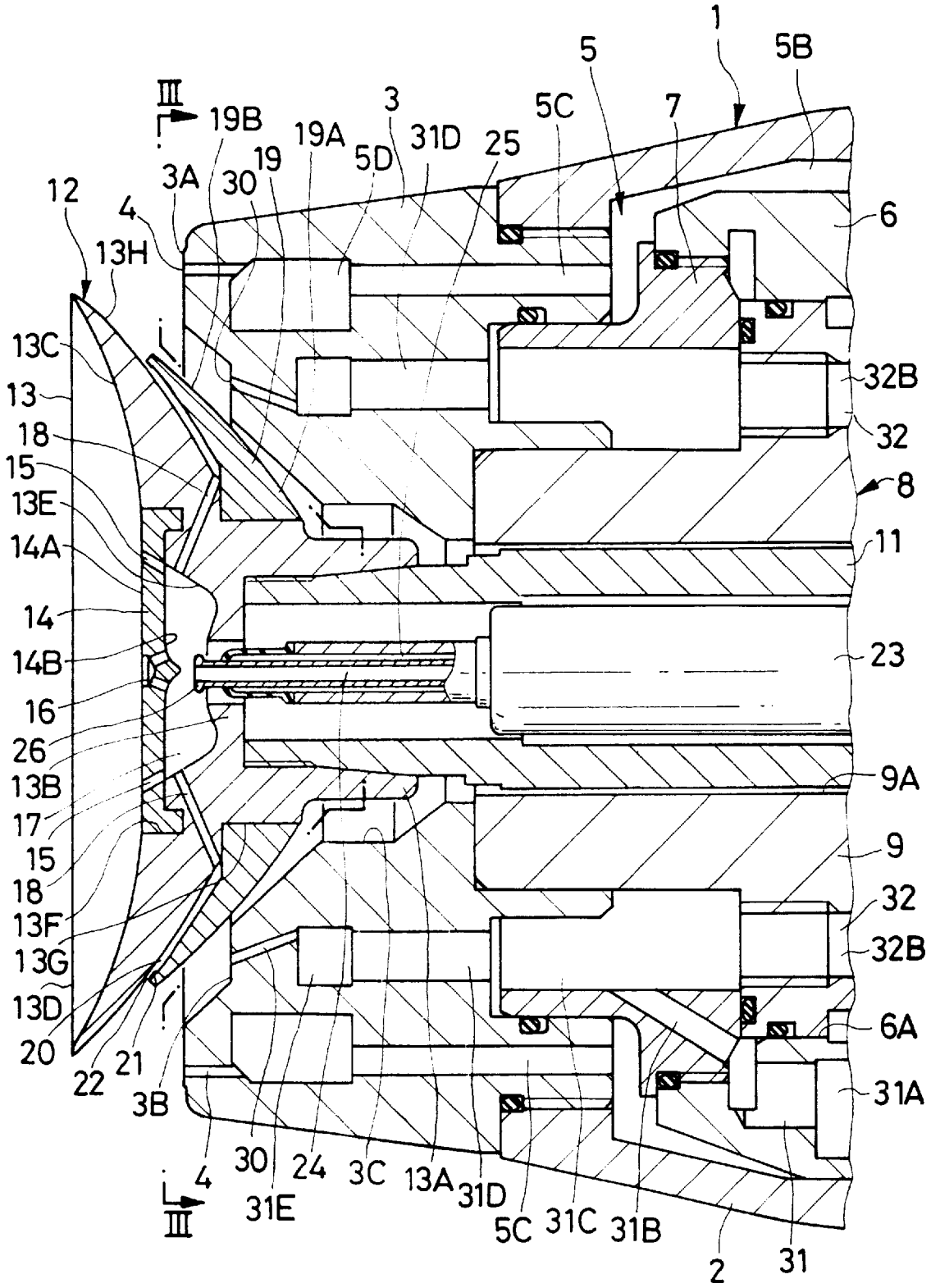
FIG. 2 is an enlarged vertical sectional view through major components of the rotary atomizing head type coating machine of FIG. 1.
Figure 3:
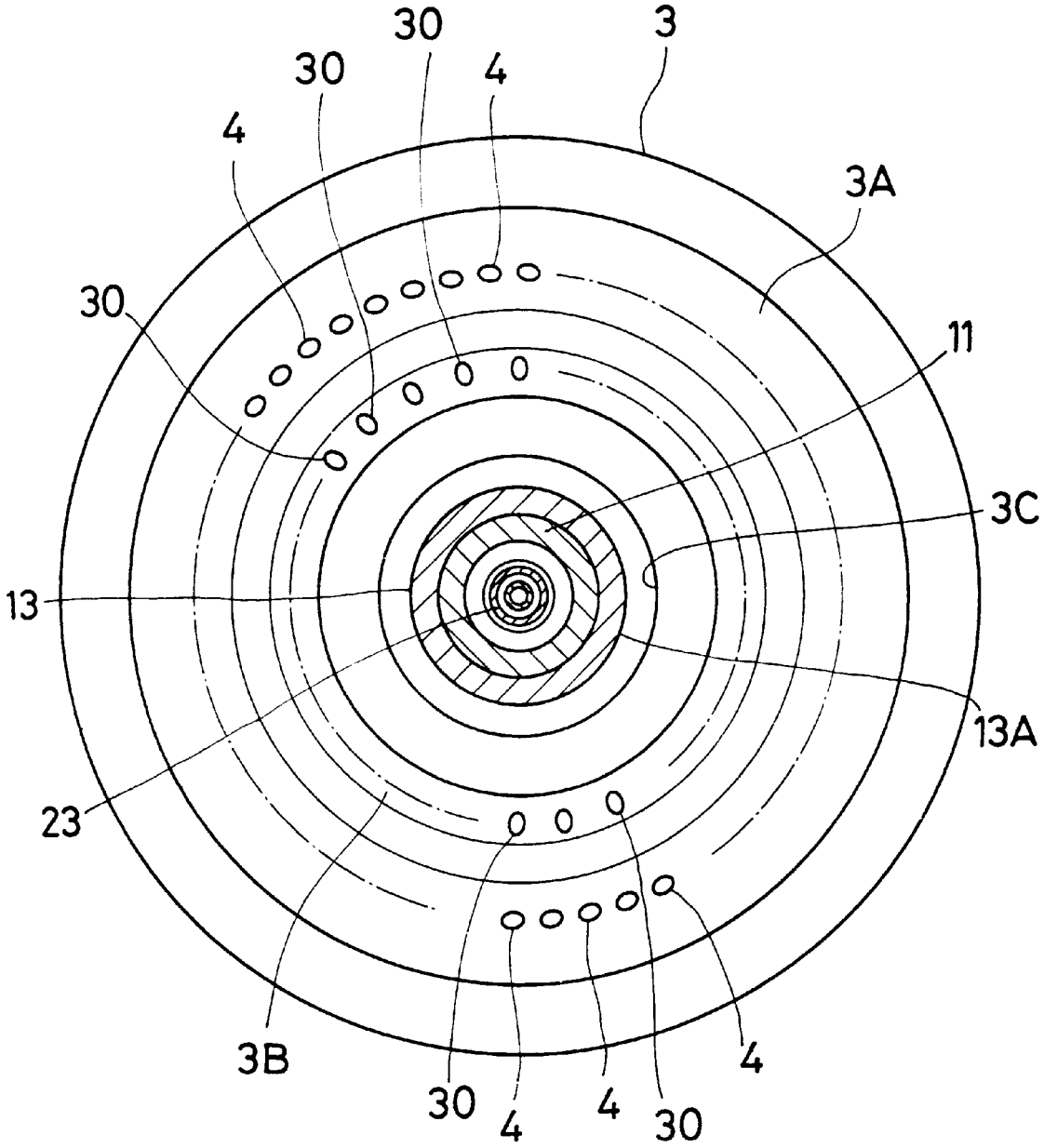
FIG. 3 is a cross-sectional view of the rotary atomizing head type coating machine taken in the direction of arrows III—III of FIG. 2.
Figure 4:
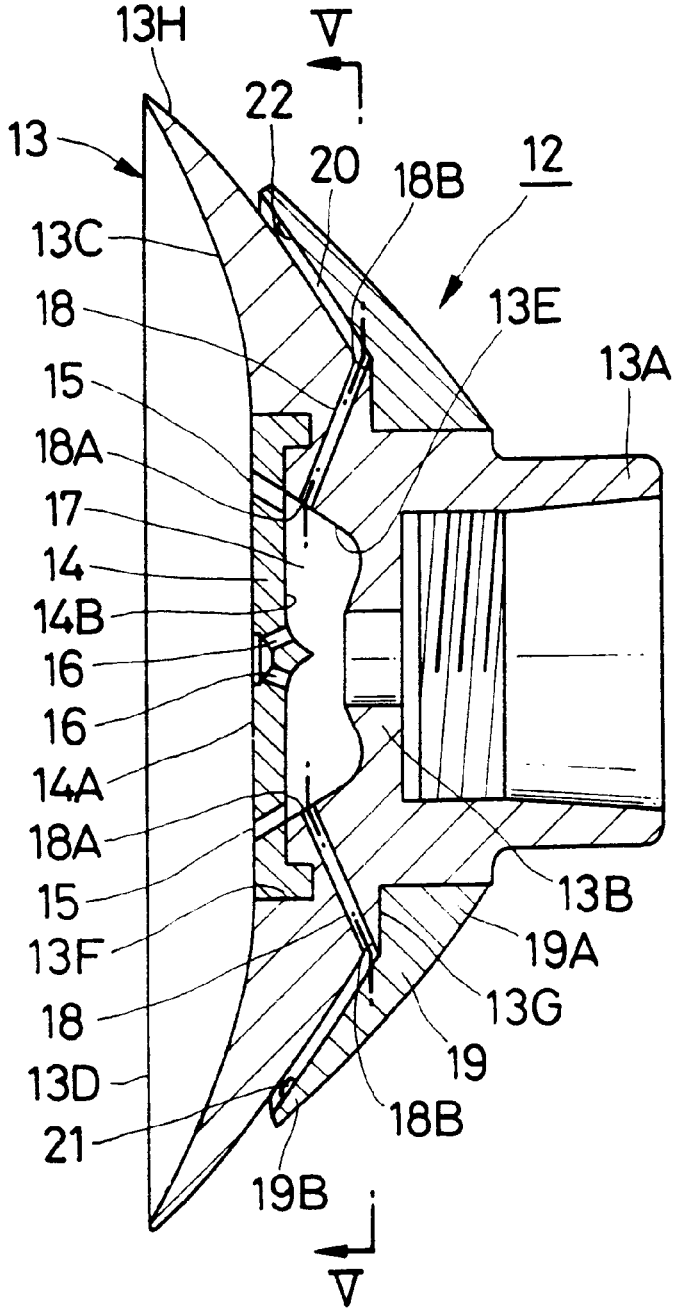
FIG. 4 is a vertical sectional view of the rotary atomizing head shown in FIG. 1.

The shaping air ring 3 is formed in a stepped cylindrical shape as shown in FIG. 2, and has a large number of shaping air outlet holes 4 arranged in an annular array on its front end face 3A as shown in FIG. 3. An annular recess 3B is formed on the inner peripheral side of the front end face 3A of the shaping air ring 3 radially on the inner side of the respective shaping air outlet holes 4. Formed contiguously on the rear side of the annular recess 3B is a receiving portion 3C which receives a rear portion of a rotary atomizing head 12 which will be described hereinafter.

Indicated at 5 is a shaping air passage which is provided between the front housing 6 and the shaping air ring 3. This shaping air passageway 5 is largely constituted by an air passage 5A which is formed axially around the outer periphery of the front housing 6, an annular passage 5B which is formed between the front cover 6 and the tubular cover body 2, a plural number of air feed passages 5C (only two air of which are shown in the drawings) which are formed axially around the outer periphery of the shaping air ring 3, and an annular air chamber 5D which is in communication with the respective air feed passages 5C. The shaping air chamber 5D is communicated with the afore-mentioned shaping air outlet holes 4. Further, the shaping air passage 5 is connected to a shaping air source through air feed pipes and a control valve or the like which are not shown in the drawings.

In this instance, through the respective shaping air outlet holes 4, shaping air is spurted toward the outer peripheral side of the rotary atomizing head 12, so that the spray of paint particles from the rotary atomizing head 12 is shaped into a suitable pattern. In addition, the shaping air serves to push a solvent like thinner against outer peripheral surface 13H of the bell cup 13 as soon as the thinner flows out through a thinner passage 18, which will be described hereinafter, at the time of washing the rotary atomizing head 12, thereby guiding the thinner toward end portions of the bell cup 13 against centrifugal force acting thereon as a result of high speed rotation of the rotary atomizing head 12.

Denoted at 6 is a front housing which is accommodated in the cylindrical cover body 2. The front housing 6 is formed in a stepped cylindrical shape and closed at the bottom end. An air motor 8 is fitted in a motor receiving cavity 6A in the front housing 6 and fixed in position by a fixation ring 7 which is threaded into an open fore end portion of the motor receiving cavity 6A.

Indicated at 8 is the air motor which is mounted within the motor receiving cavity 6A of the front housing 6 as mentioned above. This air motor 8 is constituted by a motor housing 9 of stepped cylindrical shape having an axial bore 9A for a rotational shaft and a turbine chamber 9B which is formed by spreading the diameter of deeper portions of the axial bore 9A, an air turbine 10 rotatably received in the turbine chamber 9B, and an air bearing (not shown) to permit high speed rotation of a rotational shaft 11 which will be described hereinafter. A high voltage is applied to the motor housing 9 through a high voltage cable 42 which will also be described hereinafter.

Designated at 11 is a hollow rotational shaft which is provided in the axial bore 9A of the motor housing 9. This rotational shaft 11 is rotatably supported through an air bearing for rotation at high speed, and fitted in the air turbine 10 in its base end portion. A fore end portion of the rotational shaft 11 is protruded from the motor housing 9 to support the rotary atomizing head 12 on its distal end.

The rotary atomizing head 12, which is mounted on the rotational shaft 11, is largely constituted by a bell cup 13, a hub member 14, paint outlet holes 15, thinner outlet holes 16, a paint reservoir 17, and a thinner passage 18 as described below.

The bell cup 13 which determines the outer configuration of the rotary atomizing head 12 is formed in a bell- or cup-like shape which is spread from rear to front side thereof, and provided with a shaft fixing portion 13A on its rear side to be threaded on the fore distal end of the rotational shaft 11. Further, the bell cup 13 is centrally provided with an annular partition wall 13B which is projected in a radially inward direction. Extended into the inner periphery of the annular partition wall 13B is the fore end of a feed tube 23 which is protruded from the fore end of the rotational shaft 11 in the manner as will be described hereinafter.

Further, the inner periphery of the bell cup 13 is gradually increased in diameter in a skirt-like fashion toward its fore end from the annular partition wall 13B. Front portions of the inner peripheral surface of the bell cup 13 provide a paint spreading surface 13C to spread a paint into thin films toward marginal releasing edge 13D at its front end. On the other hand, rear portions of the inner peripheral surface of the bell cup 13 provide a paint receiving surface 13E for receiving paint or thinner thereon. Furthermore, the bell cup 13 is formed with a hub mounting groove 13F between the film spreading surface 13C and the paint receiving surface 13E, along with a guide mounting portion 13G which is provided in an axially intermediate position on its outer periphery.

Indicated at 14 is a hub member which is fitted in the hub mounting groove 13F of the bell cup 13, defining a paint reservoir 17 between its inner face and the bell cup 13. The hub member 14 is formed in a circular disk-like shape and mounted in coaxial relation with the bell cup 13. Further, the hub member 14 is provided with a flat front face 14A which is continuously adjoined with the paint spreading surface 13C. The rear face of the hub member 14 serves as a paint supply surface 14B.

In this instance, liquid contacting surfaces of the rotary atomizing head 12 include the paint spreading surface 13C, marginal releasing edge 13D and paint receiving surface 13E of the bell cup 13 and the front face 14A and paint supply surface 14B of the hub member 14.

Indicated at 15 are a large number of paint outlet holes (only two of which are shown in the drawings) which are arranged circularly along and on the side of the outer periphery of the hub member 14. Through these paint outlet holes 15, paint or thinner, which has been spouted on the inner peripheral side of the bell cup 13, is allowed to flow out onto the paint spreading surface 13C.

Denoted at 16 are a plural number of thinner outlet holes (only two of which are shown in the drawings) which are provided around the center of the hub member 14 to connect the paint supply surface 14B with the front face 14A thereof. At the time of washing the rotary atomizing head 12, the thinner which has been spouted into the inner peripheral side of the bell cup 13 from the feed tube 23 is allowed to flow out onto the front face 14 of the hub member 14 through these thinner outlet holes 16.

Indicated at 17 is the paint reservoir which is defined between the paint supply surface 14B and the paint receiving surface 13E of the bell cup 13 by mounting the hub member 14 in the hub groove 13F on the bell cup 13. In this instance, the paint or thinner which has been spouted out through the feed tube 23 is temporarily held in the paint reservoir 17 and diffused over the entire space of the paint reservoir.

Designated at 18 are a plural number of thinner passages (only two of which are shown in the drawings) which are provided at predetermined intervals in the circumferential direction of the bell cup 13. These thinner passages 18 are opened to the paint receiving surface 13E of the bell cup 13 as an inlet openings 18A and to the outer periphery 13H of the bell cup 13 as an outlet openings 18B at their inlet and outlet, and extend from the inner peripheral side to the outer peripheral side of the bell cup 13 respectively. Therefore, at the time of washing the rotary atomizing head 12, the thinner which has been introduced into the paint reservoir 17 through the thinner supply passage 25 of the feed tube 23 is allowed to flow out onto the outer peripheral side of the bell cup 13 through respective thinner passages 18.

Figure 6:
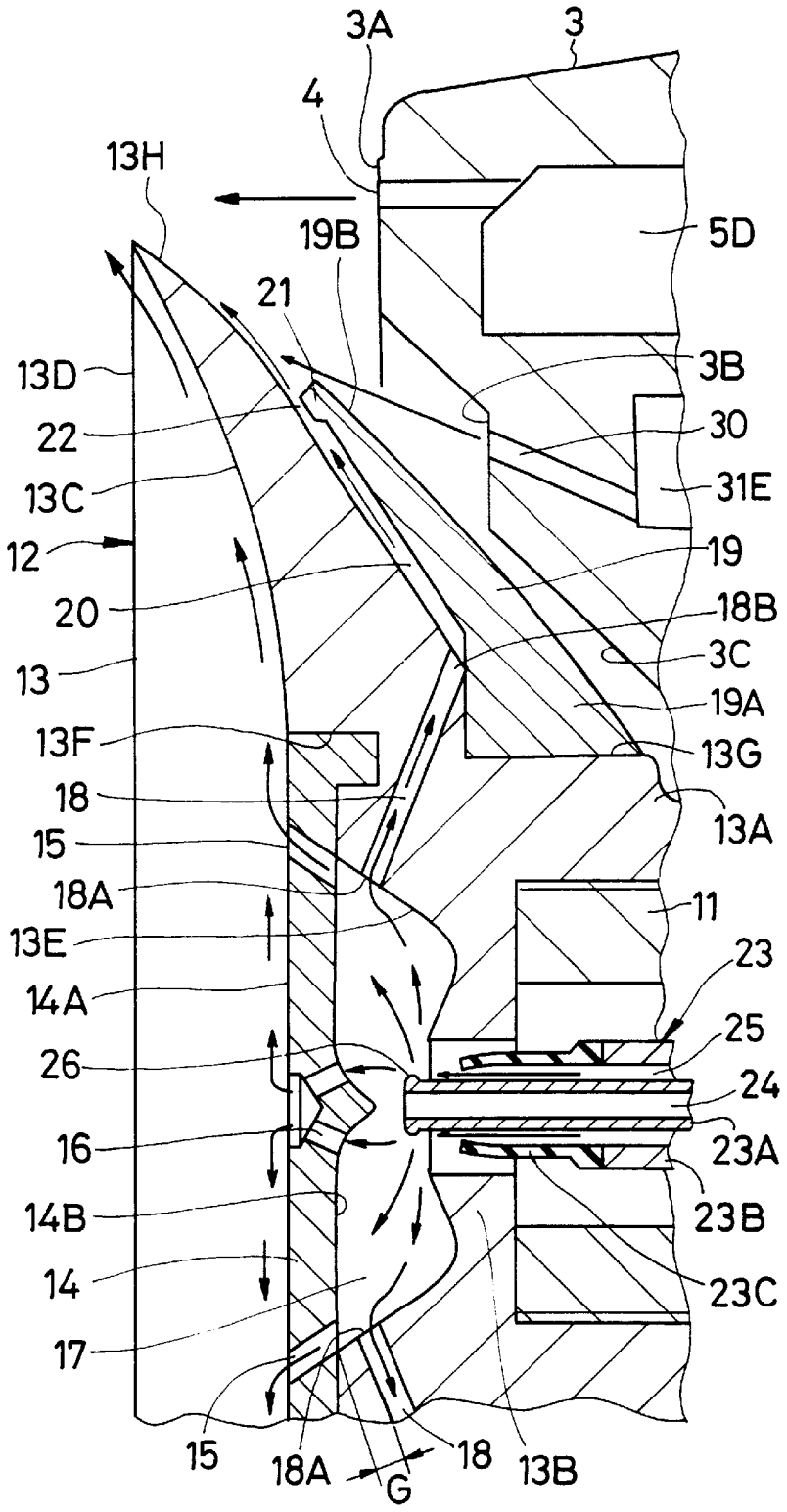
FIG. 6 is an enlarged vertical sectional view through major component parts of the rotary atomizing head of FIG. 2 under a washing treatment.

In this instance, as shown in FIG. 6, the inlet openings 18A of the thinner passages 18 are located in deeper positions than the respective paint outlet holes 15 with a predetermined spacing G from the paint outlet holes. Therefore, during a paint coating operation, the paint which has been supplied to the paint reservoir 17 through the paint supply passage 24 of the feed tube 23 is prevented from flowing into the thinner passages 18. On the other hand, during a washing operation, the thinner which has been supplied to the paint reservoir 17 through the thinner supply passage 25 is allowed to flow into the thinner passages 18.

The respective thinner passages 18 are inclined toward the rear side of the bell cup 13 gradually from the inlet openings 18A to the outlet openings 18B. Namely, as compared with the positions of the inlet openings 18A, the positions of the outlet openings 18B of the thinner passages 18 are shifted in a direction rearward of the bell cup 13. Consequently, the paint is prevented from flowing into the thinner passages 18 during paint coating operations.

Figure 5:
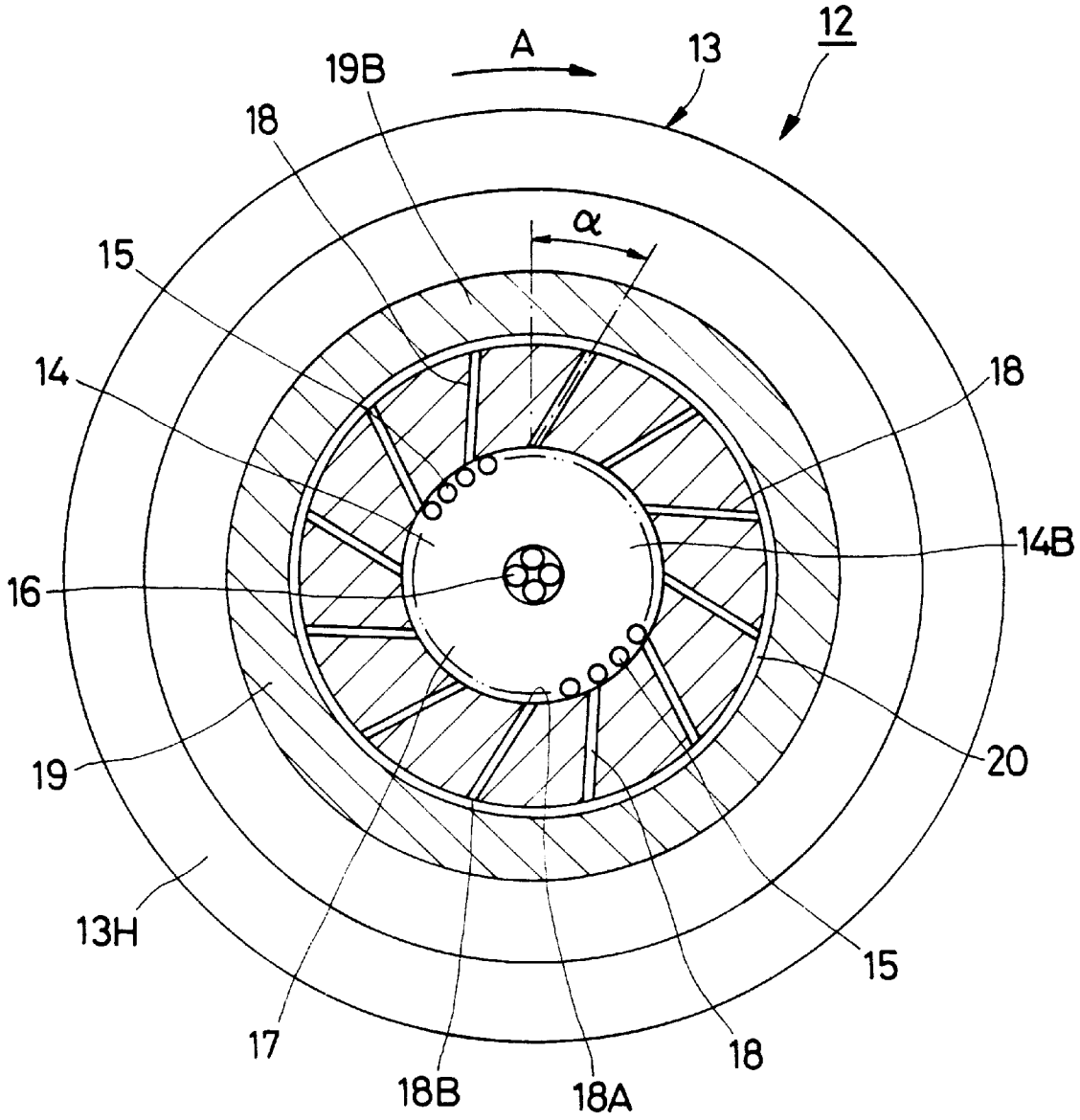
FIG. 5 is a cross-sectional view of the rotary atomizing head taken in the direction of arrows V—V of FIG. 4.

In addition, as shown in FIG. 5, the thinner passages 18 are inclined in the rotational direction (in the direction of arrow A), that is to say, are twisted in the rotational direction of the rotary atomizing head 12 gradually from their inlet openings 18A to the outlet openings 18B. Namely, each one of the thinner passages 18 is inclined through a predetermined angle $\alpha$, for example, through an angle in the range between 15° and 50° relative to the radius of the bell cup 13. Therefore, at the time of a washing operation for the rotary atomizing head 12, the thinner which has been spouted into the paint reservoir 17 is allowed to flow into the respective thinner passages 18 in a more facilitated manner.

Indicated at 19 is an annular guide which is mounted on the stepped mount portion 13G of the bell cup 13. The annular guide 19 includes an annular base portion 19A which is fitted on the stepped mount portion 13G, and a spread front portion 19B of bell- or cup-like shape which is diverged in the forward direction from the annular base portion 19A to extend in a predetermined spaced relation with the outer peripheral surface 13H of the bell cup 13.

Indicated at 20 is a thinner diffusing chamber which is formed between the inner peripheral surface of the forwardly spread front portion 19B of the annular guide 19 and the outer peripheral surface 13H of the bell cup 13. This thinner diffusing chamber 20 is formed annularly around the entire periphery of the bell cup 13, and an outlet opening 18B of the thinner supply passage 18 is opened at the depth of the thinner diffusing chamber 20.

Denoted at 21 is an annular protuberance which is provided on the inner peripheral surface of the forwardly spread front portion 19B of the annular guide 19. This annular protuberance 21 is formed around the entire inner periphery of the annular guide 19 to form an annular constricted passage 22 around the outer peripheral surface 13H of the bell cup 13. At the time of washing the rotary atomizing head 12, the annular protuberance 21 functions as a dam for temporarily holding back the thinner to be spread toward the fore end of the bell cup 13.

The feed tube 23 is axially provided internally of the rotational shaft 11, and has a double tube construction including an inner tube 23A and an outer tube 23B which is formed coaxially around the outer periphery of the inner tube 23A. Base end portion of the feed tube 23 is fitted in the motor housing 9 of the air motor 8. The inner tube 23A has its fore end protruded from the rotational shaft 11 and the outer tube 23B to extend into the paint reservoir 17 on the rotary atomizing head 12. On the other hand, the outer tube 23B is provided with a check valve 23C which is resiliently abutted against the outer periphery of the inner tube 23A at its fore end, and said check valve 23 is opened when thinner is supplied from the thinner supply passage 25.

The inner tube 23A internally provides the paint supply passage 24 which is connected to a color changing valve device through a paint feed pipe (both not shown). Formed between the inner tube 23A and the outer tube 23B is an annular thinner supply passage 25 which is connected to a thinner source through a thinner feed pipe (both not shown).

Indicated at 26 is a flange portion which is formed at the fore end of the inner tube 23A of the feed tube 23. The flange portion 26 is in the form of an annular protuberance which is of semi-circular shape in section and projected radially outward from the outer periphery of the inner tube 23A. Upon collision against the flange portion 26, the thinner which is spouted out of the thinner supply passage 25 is diffused to distribute a large quantity of thinner toward the respective paint outlet holes 15 and thinner passages 18 which are located in outer positions. At the same time, the semi-circular shape of the flange portion 26 serves to suppress scattering of the thinner to some extent and to supply a part of thinner toward the centrally located thinner outlet holes 16.

Denoted at 27 is a rear housing which is provided on the rear side of the front housing 6. This rear housing 27 is connected to an arm 29 of a coating robot or the like (not shown) through a rear plate 28.

Indicated at 30 are a large number of assist air outlet holes which are provided in the shaping air ring 3. As shown in FIG. 3, the assist air outlet holes 30 are located radially on the inner side of the shaping air outlet holes 4 and opened in a circular array at the bottom of the annular recess 3B of the shaping air ring 3. Further, as shown in FIG. 6, assist air is blown out through the assist air outlet holes 30 in the directions between the front ends of the spread front portion 19B of the annular guide 19 and of the outer peripheral surface 13H of the bell cup 13, so that the thinner coming out of the thinner diffusing chamber 20 through the annular constricted passage 22 is forcibly pushed against the outer peripheral surface 13H of the bell cup 13.

Designated at 31 is an assist air passage which supplies assist air to the assist air outlet holes 30, and includes: an air supply passage 31A which is extended axially through or along outer peripheral portions of the rear plate 28, rear housing 27 and front housing 6; an oblique passage 31B which is connected to the fore end of the air supply passage 31A and extended obliquely through the fixation ring 7; an annular air gallery 31C which is defined between the motor housing 9 and the fixation ring 7 in communication with the oblique passage 31B; a plural number of distribution passages 31D (only two of which are shown in the drawing) which are extended forward from the annular air gallery 31C through the shaping air ring 3; and an annular air chamber 31E which is formed in front of and in communication with the fore ends of the respective distribution passages 31D. The air chamber 31E is communicated with the above-described assist air outlet holes 30.

Indicated at 32 are exhaust air passages, for example, a couple of exhaust air passages which both serve to discharge compressed air which has been used for rotation of the air turbine 10. Each exhaust air passage 32 is bifurcated on the downstream side into a first branch passage 32A and a second branch passage 32B. The first branch passage 32A of each exhaust air passage 32 is opened on the outer periphery of the motor housing 9 and communicated with an exhaust passage 33 which is extended axially through or along outer peripheral portions of the front housing 6, rear housing 27 and rear plate 28. On the other hand, the second branch passage 32B is opened forward of the motor housing 9 and communicated with the annular air gallery 31C of the assist air passage 31.

In this instance, indicated at 34 is a plug which is removably attached to the rear plate 28 at the open end of an air discharge passage 33 thereby closing the air discharge passage 33 and letting exhaust air from the air motor be discharged through the second branch passage 32B of each exhaust air passage 32.

Each one of the second branch passages 32B is tapped with internal screw thread for engagement with a plug (not shown) which can be removably threaded thereinto. As a consequence, it is possible to establish or block the communication between the air discharge passage 33 and the assist air passage 31. In case the second branch passage 32B is plugged and the above-mentioned plug 34 is removed, the machine is arranged in the manner as in a second embodiment of the invention which will be described hereinafter.

Indicated at 35 is an air feed pipe which is connected with the air supply passage 31A of the assist air passage 31 to connect same with a pressurized air source 36 like a compressor.

Designated at 37 is an assist air control means or controller which is provided within the length of the air feed pipe 35. The assist air controller 37 is largely constituted by a regulator valve 38 which is provided within the length of the air feed pipe 35 and a control unit 40 which is connected to the regulator valve 38 through lead wire 39. While monitoring the flow rate or pressure of shaping air blown out through the respective shaping air outlet holes 4 as well as the flow rate or pressure of exhaust air supplied from the respective exhaust air passages 32 by the control unit 40, the assist air controller 37 permits to control the regulator valve 38 by signals from the control unit 40 for adjusting the air supply from the pressurized air source 36 to the assist air passage 31 to an optimum value.

In this instance, since the pressure of compressed air corresponds to its flow rate, a pressure regulator valve or a flow regulator valve can be employed for the regulator valve 38. The opening of the regulator valve 38 can be controlled by feeding back the supply air pressure in the air feed pipe 35 to the control unit 40.

Indicated at 41 is a detection cable which is passed axially through the front housing 6, rear housing 27 and rear plate 28 for detecting the rotational speed of the air turbine 10 of the air motor 8, and at 42 is a high voltage cable which is passed through the rear housing 27 and connected to the motor housing 9 through a connector cable 43.

With the rotary atomizing head type paint coating machine of the present embodiment, which is arranged as described above, paint coating operations are performed in the manner as follows.

At the time of a coating operation, firstly the air motor 8 is started to put the rotary atomizing head 12 in high speed rotation along with the rotational shaft 11. In the next place, paint is fed from the paint supply passage 24 of the feed tube 23 to the paint reservoir 17 on the rotary atomizing head 12. As a result, the paint which has been introduced into the paint reservoir 17 is allowed to flow out onto the paint spreading surface 13C of the bell cup 13 through the respective paint outlet holes 15. The paint is spread into a thin film on the paint spreading surface 13C and then released forward from the releasing edges 13D in the form of finely atomized paint particles.

At this time, a high voltage is applied to the motor housing 9 of the air motor 8 through the high voltage cable 42 and connector cable 43. Since the high voltage is also applied to the rotary atomizing head 12 which is electrically connected with the motor housing 9 through the rotational shaft 11, an electrostatic field is formed between the rotary atomizing head 12 and a coating object which is connected to the earth. As a result, atomized paint particles released from the rotary atomizing head 12 are urged to fly along the electrostatic field and deposit on the coating object. On the other hand, the sprays of paint particles are shaped into a desired pattern by shaping air which is spurted out through the respective shaping air outlet holes 4.

When it becomes necessary to change the paint color, air and thinner are supplied from a color changing valve device to wash away paint of a previous color which has deposited in or on paint feed pipes, paint supply passage 24 and rotary atomizing head 12 before paint of a fresh or next color is supplied from the color changing valve device to fill the paint supply passage 24 and so forth.

However, when paint of a next color is supplied in this manner, the paint which has been spouted into the rotary atomizing head 12 from the paint supply passage 24 may deposit on the front face 14A of the hub member 14 and the outer peripheral surface 13H of the bell cup 13 of the rotary atomizing head 12. Besides, solidification occurs to the paint which has deposited on the rotary atomizing head, for example, on the inner peripheral surface of the bell cup 13 of the rotary atomizing head 12 when a coating operation is temporarily suspended due to a trouble on a coating line or for a lunch-time break. Further, in a coating operation using paint of the same color for a long period of time, the paint may deposit and accumulate on the rotary atomizing head 12.

In such a case, since solidified paint on the rotary atomizing head 12 could fall off in fragments to cause coating defects, paint deposits on various parts of the rotary atomizing head 12 have to be washed off.

Described below is a washing operation for removing deposited paint from various parts of the rotary atomizing head 12.

Firstly, for a rotary atomizing head washing operation, the rotary atomizing head 12 is rotated by the air motor 8 along with the rotational shaft 11, and thinner is supplied through the thinner supply passage 25 of the feed tube 23. At this time, as shown in FIG. 6, the check valve 23C is opened to feed thinner to the paint reservoir 17 through the thinner supply passage 25.

The thinner which has been spouted from the thinner supply passage 25 is collided against the flange portion 26, which is projected in radially outward direction at the fore end of the inner tube 23A, and scattered around over a wide range within the paint reservoir 17. While being scattered around within the paint reservoir 17, a part of the thinner is distributed toward the paint outlet holes 15 and the thinner passages 18, which are located in outer peripheral regions. Because of the arcuately round shape of the flange portion 26, other part of the thinner is scattered in a less degree and distributed toward the respective thinner outlet holes 16 which are located in center regions.

Accordingly, the thinner portion which has been scattered within the paint reservoir 17 toward the respective paint outlet holes 15 is urged to flow out onto the paint spreading surface 13C of the bell cup 13 through the paint outlet holes 15. Consequently, deposited paint on the paint spreading surface 13C and the marginal releasing edge 13D of the bell cup 13 is washed away with the thinner which is eventually released from the marginal releasing edge 13D.

Further, a part of the thinner which has been distributed toward the thinner outlet holes 16 is urged to flow out through the respective thinner outlet holes 16 onto the front face 14A of the hub member 14 to wash away deposited paint therefrom. This part of the thinner is then allowed to flow over the paint spreading surface 13C and eventually released from the marginal releasing edge 13D.

On the other hand, a part of the thinner which has been distributed toward the inlet openings 18A of the thinner passages 18 is urged to flow out in radially outward directions of the bell cup 13 through the respective thinner passages 18. However, since the annular guide 19 is provided around the entire outer peripheral side of the bell cup 13, the thinner which comes out of the respective thinner passages 18 is caused to flow through the thinner diffusing chamber 20 under the guidance of the annular guide 19 toward the front end of the annuler guide 19 until it collides against the annular protuberance 21. By the afore-mentioned dam effects of the annular protuberance 21, the thinner is temporarily held back and then diffused around the entire periphery of the bell cup 13 within the thinner diffusing chamber 20 under the influence of centrifugal force.

Then, the thinner in the diffusing chamber 20 is guided along the spread front portion 19B of the annular guide 19 toward the front portion of the bell cup 13 to flow onto the outer peripheral surface 13H of the bell cup 13, flowing over the annular protuberance 21 and through the annular constricted passage 22.

During the washing operation, air is supplied to the shaping air outlet holes 4 from the shaping air supply passage 5 to spurt shaping air toward the outer peripheral side of the rotary atomizing head 12 through the respective shaping air outlet holes 4. At the same time, air is supplied to the assist air supply passage 31 from the pressurized air source 36 through the air feed pipe 35, and joined by exhaust air from the air motor 8 before it is spurted out through the assist air outlet holes 30 in the directions between the fore ends of the spread front portion 19B of the annular guide 19 and of the outer peripheral surface 13H of the bell cup 13.

The thinner which has come out onto the outer peripheral surface 13H of the bell cup 13 normally tends to scatter away in radially outward directions under the influence of centrifugal force resulting from high speed rotation of the rotary atomizing head 12, but instead the thinner is pushed against the outer peripheral surface 13H of the bell cup 13 by the actions of assist air, which is spurted out through the respective assist air outlet holes 30, and shaping air which is spurted out through the respective shaping air outlet holes 4. As a result, the thinner is guided toward the front end of the bell cup 13 along the outer peripheral surface 13H, washing away deposited paints from fore end portions of the outer peripheral surface 13H of the bell cup 13.

Figure 7:
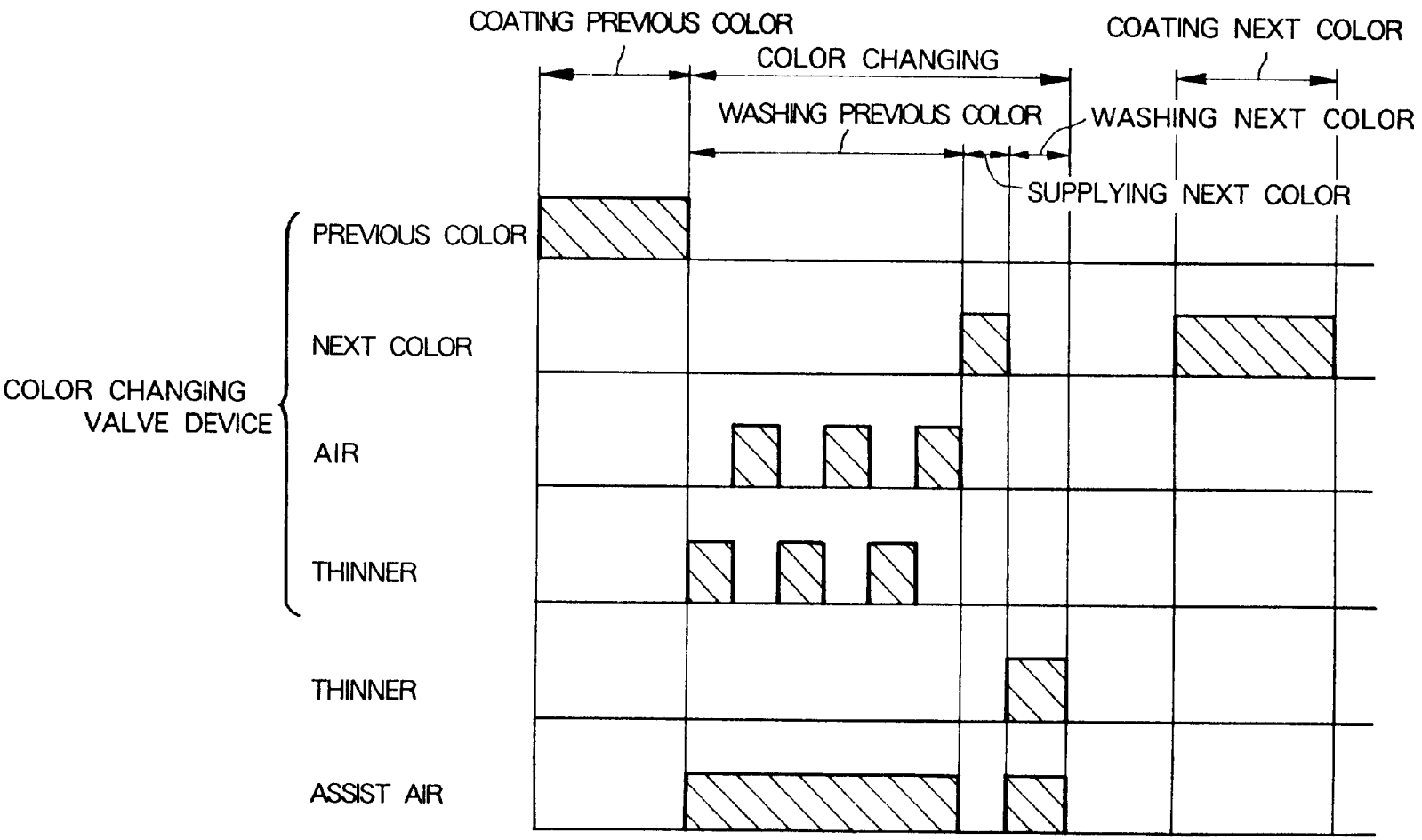
FIG. 7 is a diagram explanatory of tasks performed in coating and washing operations.

Shown in FIG. 7 is a sequence of operations including paint coating operations for two different colors intervened by a color changing operation. In this particular case, the outer peripheral surface 13H of the bell cup 13 is washed with thinner and assist air after supply of a next color.

Thus, according to the present embodiment, the thinner which is spouted into the paint reservoir 17 at the time of washing the rotary atomizing head 12 is once introduced into the thinner diffusing chamber 20 through the respective thinner passages 18 and then allowed to flow onto the outer peripheral surface 13H of the bell cup 13. At this time, by the actions of assist air spurted out through the respective assist air outlet holes 30 and shaping air similarly spurted out through the respective shaping air outlet holes 4, the thinner is forcibly pushed against the outer peripheral surface 13H of the bell cup 13 as it is guided toward the front end of the bell cup 13. Consequently, the thinner can be fed toward the front end of the outer peripheral surface 13H of the bell cup 13 in intimate contact with the front end to wash away deposited paint in an assured manner.

Thus, the above-described arrangements require only a minimum necessary amount of thinner, suppressing the thinner consumption to a significant degree as compared with a case where a washing nozzle is provided exclusively as in the prior art described hereinbefore. Besides, it becomes possible to shorten the washing time due to improvements in washing efficiency. Nevertheless, the coating machine of the present invention can be arranged in simpler construction and reduced in the number of component parts and production cost.

Further, by the use of shaping air spurted toward the rotary atomizing head 12 from the shaping air outlet holes 4 in combination with assist air spurted out from the assist air outlet holes 30 which are provided radially on the inner side of the shaping air outlet holes 4, the thinner is pushed strongly against the outer peripheral surface 13H of the bell cup 13 to improve the washing efficiency for deposited paint all the more.

Furthermore, in addition to air from the pressurized air source 36, exhaust air from the air motor 8 is effectively and economically used as assist air to be spurted out from the respective assist air outlet holes 30. This makes is possible to reduce the flow rate of assist air from the pressurized air source 36 for the purpose of lessening the burdens of the pressurized air source 36.

Moreover, air supply from the pressurized air source 36 is under control of the assist air controller 37, so that the flow rate or pressure of assist air to be spurted out from the respective assist air outlet holes 30 can be controlled to an optimum value. Therefore, the thinner can be pushed against the outer peripheral surface 13H of the bell cup 13 most effectively in terms of improvements in washing efficiency.

On the other hand, by collision against the flange portion 26 which is projected radially outward at the fore distal end of the inner tube 23A of the feed tube 23, the thinner can be distributed in such a way as to direct a large amount of thinner toward the respective paint outlet holes 15 while supplying part of thinner toward the thinner outlet holes 16 and the thinner passages 18. As a result, a larger quantity of thinner can be supplied to the flow path of the paint including the paint spreading surface 13C and marginal releasing edge 13D where the paint is most likely to deposit, thereby precluding the trouble of deficient washing which might result from insufficient supply of thinner and at the same time shortening the washing time to ensure improvements in washing efficiency, coating quality and productivity.

Figure 8:
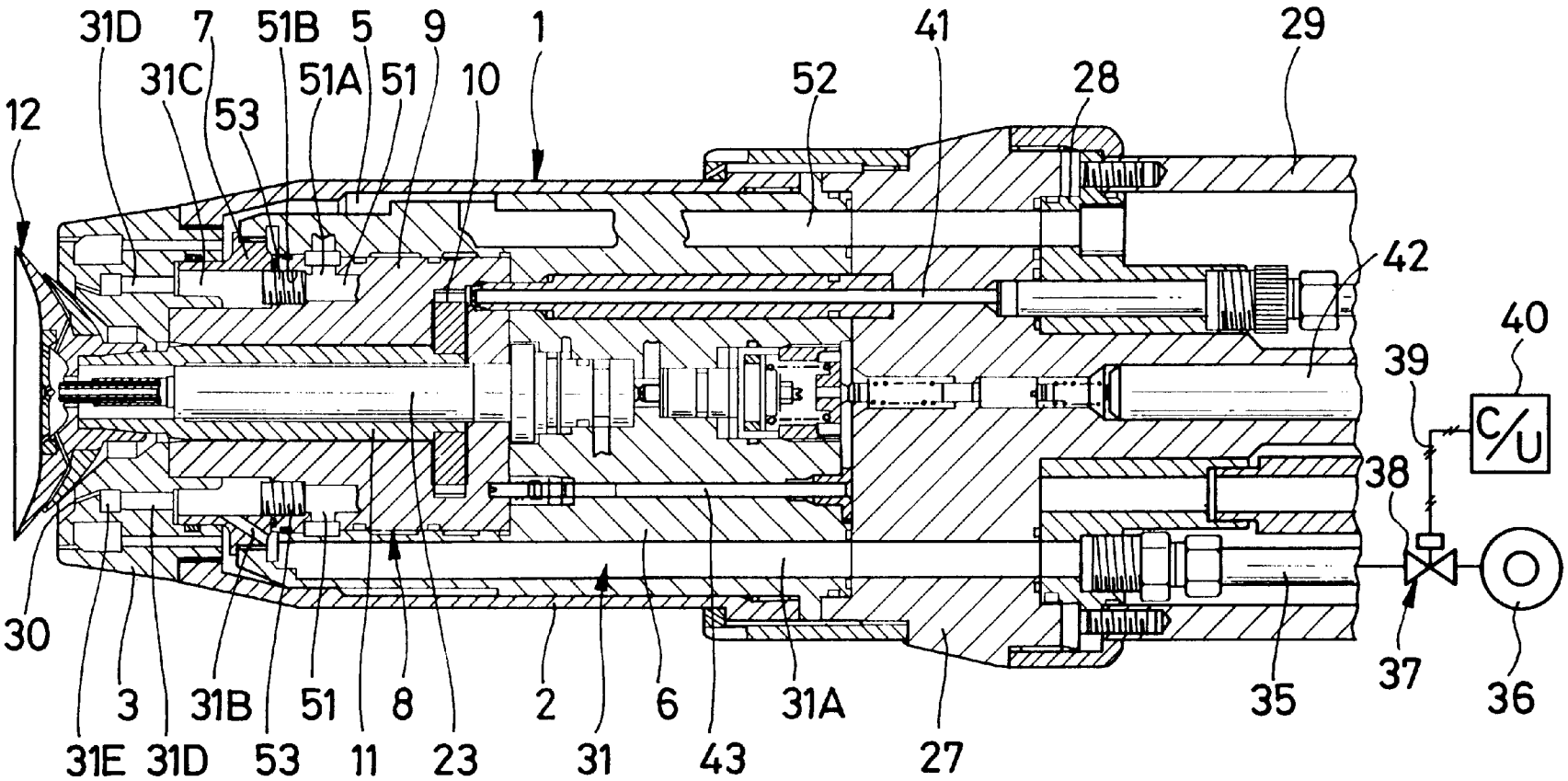
FIG. 8 is a vertical sectional view of a rotary atomizing head type coating machine adopted as a second embodiment of the present invention.
Figure 9:
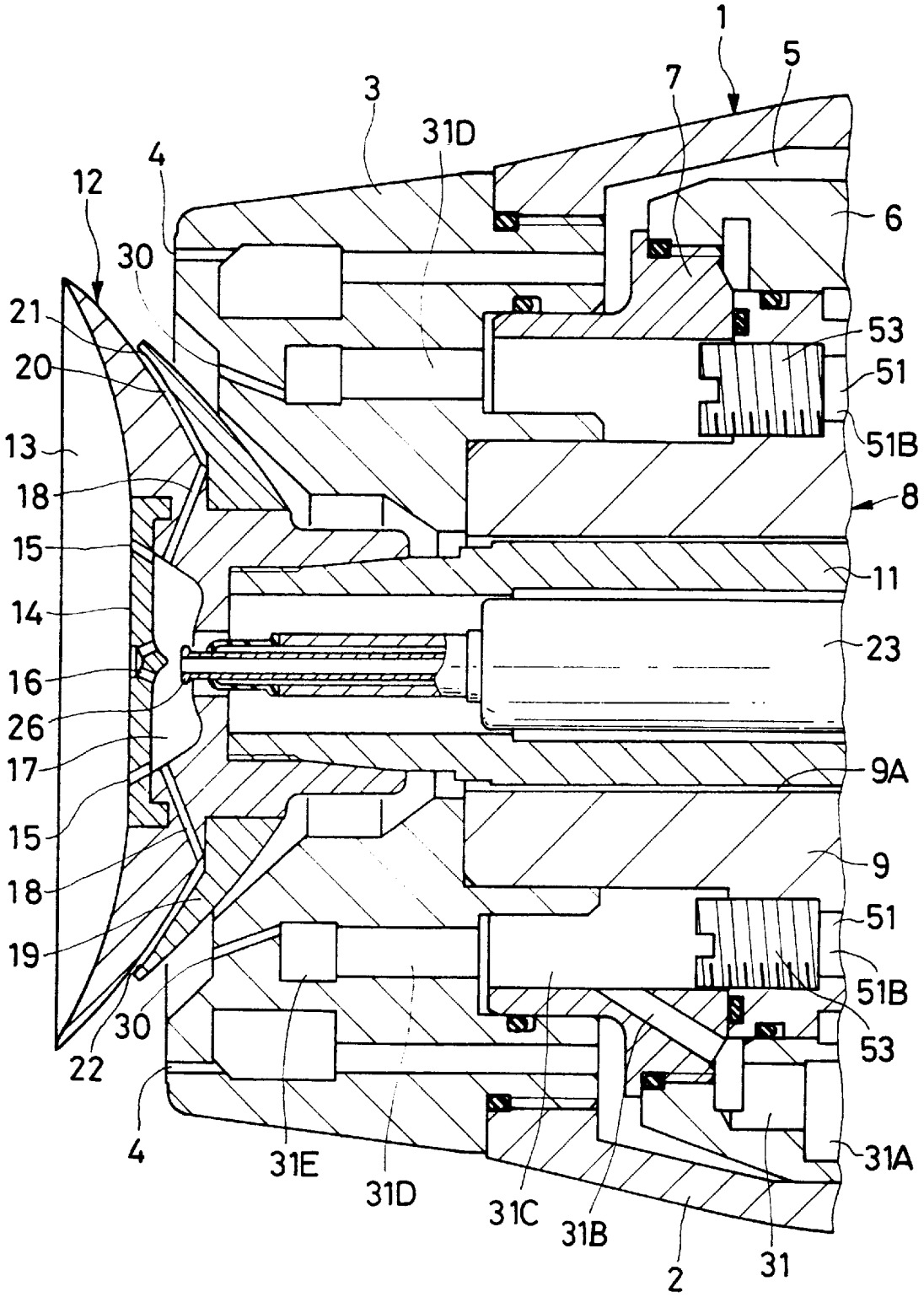
FIG. 9 is an enlarged vertical sectional view through major component parts of the rotary atomizing head type coating machine shown in FIG. 8.

Referring now to FIGS. 8 and 9, there is shown a second embodiment of the present invention, in which arrangements are made to spurt compressed air from a pressurized air source alone through assist air outlet holes, instead of using exhaust air from an air motor as a part of assist air. In the following description, those component parts which are identical with the counterparts in the above-described first embodiment are simply designated by similar reference numerals or characters to avoid repetition of same explanations.

In these figures, indicated at 51 are exhaust air passages which are provided in the motor housing 9 of the air motor 8. Similarly to the exhaust air passages 32 in the foregoing first embodiment, each one of these exhaust air passages 51 is bifurcated into a first branch passage 51A and a second branch passage 51B with a female screw portion. The first branch passage 51A is opened on the outer periphery of the motor housing and communicated with an air discharge passage 52 which is extended axially through the front housing 6 and rear housing 27. In this case, however, the air discharge passage 52 is not fitted with a plug like the one shown at 34 in the foregoing first embodiment, and is opened rearward at its rear end.

Denoted at 53 are plugs which are removably fitted in the second branch passages 52B of the respective exhaust air passages 51, thereby closing the second branch passages as seen in FIG. 9. Therefore, exhaust air from the air motor 8 is discharged rearward from the first branch passages 51A of the respective exhaust air passages 51 through the air discharge passage 52.

Accordingly, the assist air outlet holes 30 are supplied with air from the pressurized air source 36 alone through the assist air passage 31 after adjustments of flow rate or pressure at the assist air controller 37.

Thus, even in the case of the present embodiment with the arrangements just described, it is possible to obtain substantially the same operational effects as in the foregoing first embodiment. In this particular embodiment, however, exhaust air from the air motor 8 is discharged from the respective exhaust air passages 51 in the rearward direction through the air discharge passage 52. Accordingly, in this case, assist air to be spurted out through the assist air outlet holes 30 can be adjusted more accurately to a predetermined flow rate or pressure by the assist air controller 37, free of fluctuations or variations which occur to the amount of exhaust air of the air motor 8 depending upon conditions of coating operation. By so doing, the thinner to be used for washing the outer peripheral surface 13H of the bell cup 13 can be pushed into intimate contact with the outer peripheral surface by an appropriately adjusted amount of air for further improvements in washing efficiency.

Figure 10:
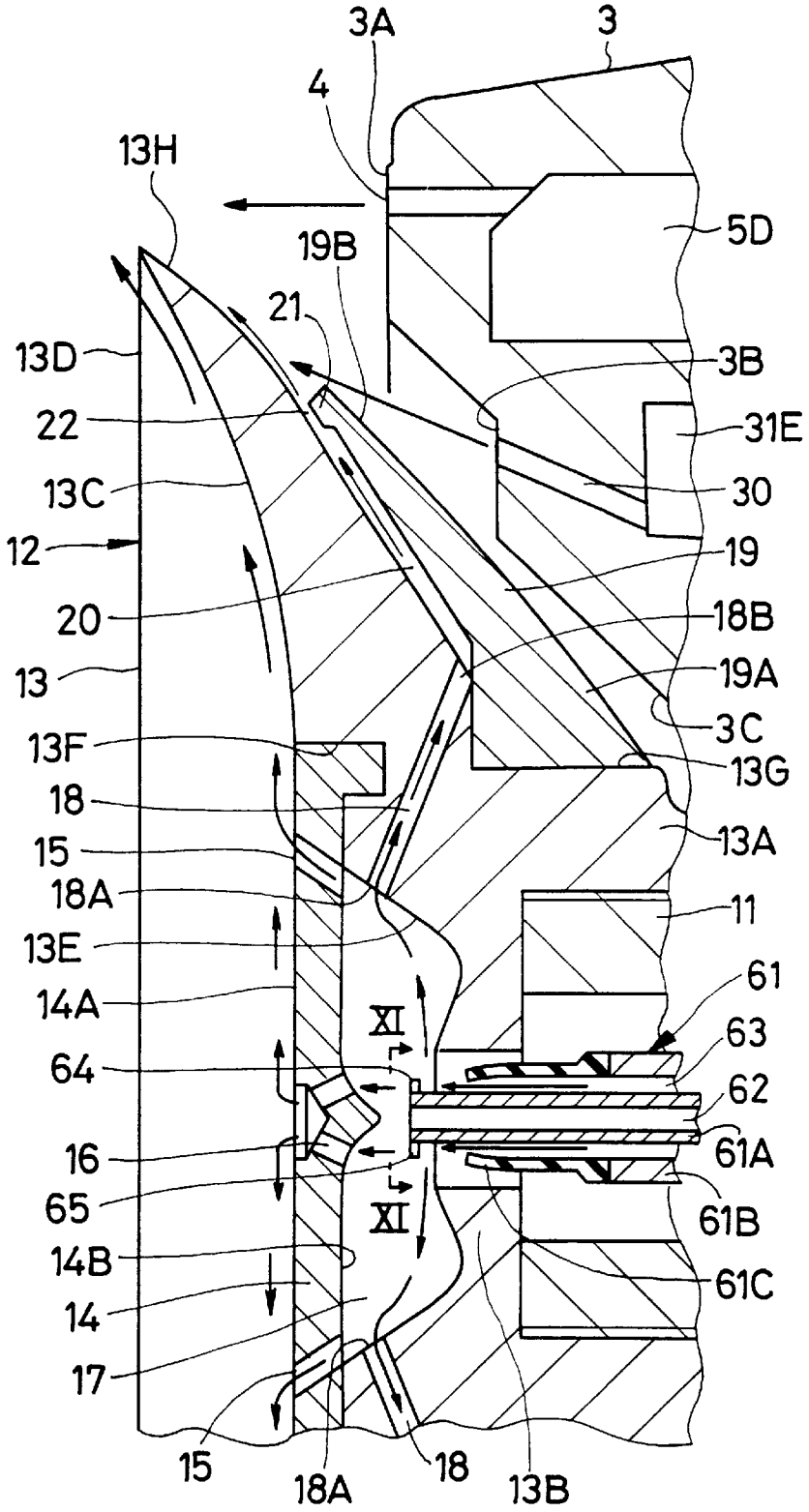
FIG. 10 is a view similar to FIG. 6 but showing a feed tube and a flange portion in a third embodiment of the present invention.
Figure 11:
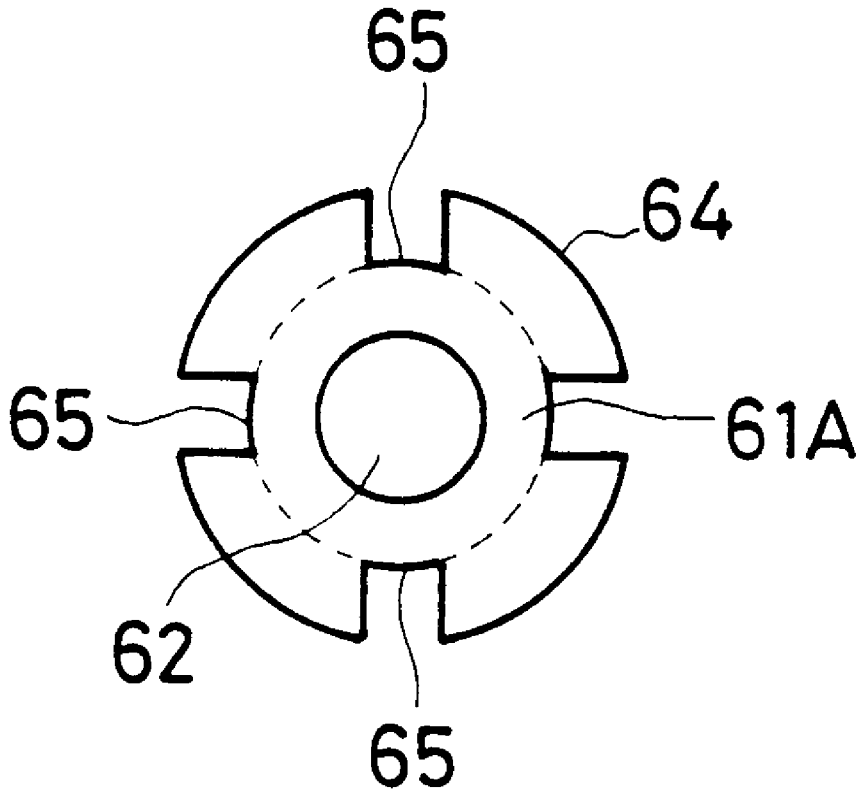
FIG. 11 is a side view of the flange portion taken in the direction of arrows XI—XI of FIG. 10.

Shown in FIGS. 10 and 11 is a third embodiment of the present invention, having a feature in that the above-described flange portion is provided with a plural number of notches at intervals in the circumferential direction. In the following description, those component parts which are identical with the counterparts in the foregoing first embodiment are simply designated by similar reference numerals or characters to avoid repetition of same explanations.

In these figures, indicated at 61 is a feed tube which is employed in this embodiment in place of the feed tube 23 of the above-described first embodiment. Similarly to the feed tube 23 of the first embodiment, the feed tube 61 is arranged in double-tube construction having an outer tube 61A and an inner tube 61B. The open end of the outer tube 61B is terminated at a position posterior to that of the inner tube 61A, and provided with a check valve 61C. Further, a paint supply passage 62 is provided internally of the inner tube 61A, while an annular thinner supply passage 63 is provided between the inner and outer tubes 61A and 61B.

Indicated at 64 is a flange portion according to this embodiment, which is formed around the fore open end of the inner tube 61A forward of the outer tube 61B of the feed tube 61. The flange portion 64 is projected radially outward from the outer periphery of the inner tube 61A substantially in the same manner as the flange portion 26 in the above-described first embodiment of the invention. The flange portion 64 of this embodiment, however, differs from the flange portion 26 of the first embodiment in that it is formed in a square shape in section and provided with notches 65 as will be described hereinafter.

Denoted at 65 are a plural number of notches, for example, four notches which are formed at angular intervals of 90° around the circumference of the flange portion 64 as shown in FIG. 11. These notches 65 are formed axially throughout the flange portion 64.

When thinner is spouted our from the thinner supply passage 63 of the feed tube 61, the flange portion 64 of this embodiment permits a part of the thinner to flow in a straightforward direction through the notches 65 for supply to the thinner outlet holes 16 which are formed in center regions of the hub member 14, as indicated by arrows in FIG. 10. The remainder of the thinner which collides against the flange portion 64 is distributed toward the respective paint outlet holes 15 in outer peripheral regions of the hub member 14 and also toward the thinner passages 18 which are opened in the paint receiving surface 13E of the bell cup 13.

Thus, even in this embodiment with the arrangement just described, there can be obtained substantially the same operational effects as in the foregoing first embodiment. Especially in this particular embodiment with the notches 65 in the flange portion 64, however, it becomes possible to distribute the thinner from the feed tube 61 to the paint outlet holes 15, thinner outlet holes 16 and thinner passages 18 in a suitable ratio by varying the size, shape and/or number of the notches 65, for example, to distribute in a ratio where (thinner to paint outlet holes 15)>(thinner to thinner outlet holes 16)>(thinner to thinner passages 18) or in a ratio where (thinner to paint outlet holes 15)>(thinner to thinner outlet holes 16)=(thinner to thinner passages 18). Accordingly, thanks to improvements in washing capacity including reductions in thinner consumption and washing time, it becomes possible to wash away deposited paint effectively from various parts of the rotary atomizing head, and therefore to improve the reliability of the rotary atomizing head type coating machine itself.

Figure 12:
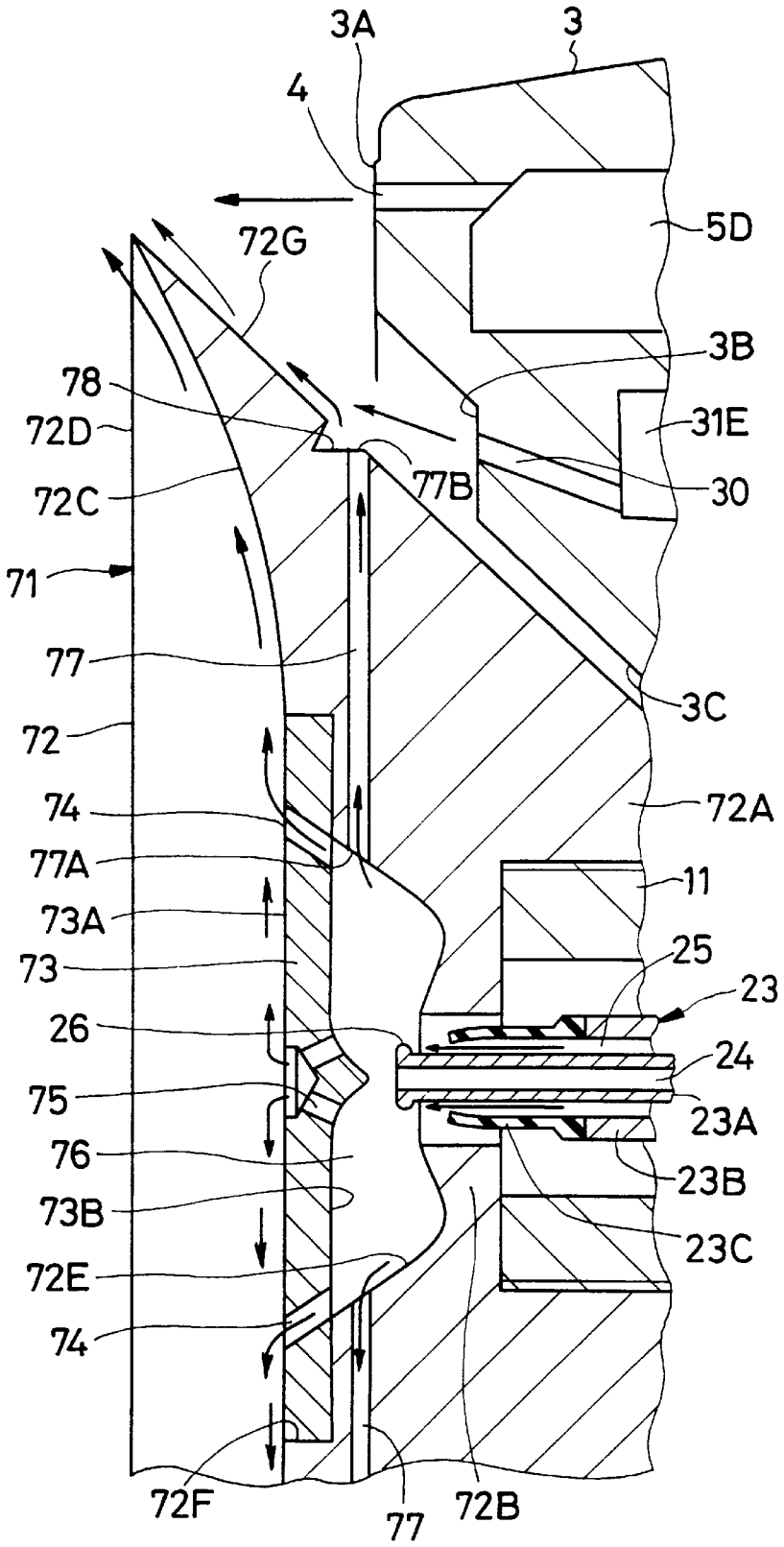
FIG. 12 is a view similar to FIG. 6 but showing a rotary atomizing head in a fourth embodiment of the present invention.

Referring now to FIG. 12, there is shown a fourth embodiment of the present invention, with a feature in that the annular guide is eliminated from the rotary atomizing head.

In that figure, indicated at 71 is a rotary atomizing head which is employed in this embodiment in place of the rotary atomizing head 12 of the first embodiment. The rotary atomizing head 71 is constituted by bell cup 72, hub member 73, paint outlet holes 74, thinner outlet holes 75, paint reservoir 76, thinner passages 77, annular barrier groove 78 and so forth, which will be described hereinafter.

The bell cup 72 which determines the outer configuration of the rotary atomizing head 71 is formed in the shape of a cup or bell which is spread from its rear side to its front side. The bell cup 72 is provided with a shaft portion 72A to be mounted on a rotational shaft, an annular partition wall 72B, a paint spreading surface 72C for spreading paint into a thin film, marginal releasing edge 72D, a paint receiving surface 72E, a stepped wall portion 72F for mounting a hub member, an outer peripheral surface 72G substantially in the same manner as the bell cup 13 of the above-described first embodiment.

Indicated at 73 is a hub member which is fitted on the stepped wall portion 72F of the bell cup 72. The hub member 73 is provided with circular disc-like front face 73A and paint supply surface 73B substantially in the same manner as the hub member 14 of the first embodiment. Besides, the hub member 73 is provided with a large number of paint outlet holes 74 in its outer peripheral regions, along with a plural number of thinner outlet holes 75 which are formed in center regions as solvent outlet holes (only two of which are shown in the drawing). Furthermore, a paint reservoir 76 is defined between the hub member 73 and the bell cup 72.

Indicated at 77 are a plural number of thinner passages (only two of which are shown in the drawing) which are provided as solvent passages at predetermined intervals in the circumferential direction of the bell cup 72. Similarly to the thinner passages 18 of the above-described first embodiment, these thinner passages 77 permit thinner in the paint reservoir 76 to enter inlet openings 77A and flow out onto the outer peripheral surface 72G of the bell cup 72 through outlet openings 77B.

Designated at 78 is an annular barrier groove which is provided on the outer peripheral surface 72G of the bell cup 72. This annular barrier groove 78 is an annular V-groove dam which is formed between the thinner passages 77 and the marginal releasing edge 72D. The annular barrier groove 78 functions to temporarily hold back the flow of thinner from the respective thinner passages 77, thereby diffusing the thinner uniformly over the outer peripheral surface 72G of the bell cup 72.

Thus, even in the case of the present embodiment with the arrangements just described, it is possible to obtain substantially the same operational effects as in the above-described first embodiment. In this particular embodiment, however, assist air which is spurted from the respective assist air outlet holes 30 is directed toward those areas between the annular barrier groove 78 and fore end portions of the outer peripheral surface 72G of the bell cup 72 for guiding the thinner toward the fore end of the bell cup 72.

In the foregoing embodiments, the present invention has been described by way of a rotary atomizing head 12 or 71 of a bell- or cup shape which is spread toward its front end from its rear end. However, similar effects can be obtained with a rotary atomizing head of other shapes, for example, with a rotary atomizing head of an elongated cylindrical shape, if the respective assist air outlet holes 30 are adjusted to spurt assist air in an appropriate direction depending upon the shape of the rotary atomizing head.

Further, in the foregoing embodiments, the invention has been described by way of a directly charging rotary atomizing head type coating machine which is arranged to apply a high voltage to paint particles sprayed from a rotary atomizing head 12 or 71 through air motor 8, feed tube 23 or 61 and so forth. However, instead of a direct charging type, the present invention can be similarly applied to an indirectly charging rotary atomizing head type coating machine in which a corona discharge is formed forward of a rotary atomizing head for applying a high voltage to sprayed paint particles, and the present invention can be applied to a non-electrostatic rotary atomizing head type coating machine.

Further, although a flange portion 26 or 64 is integrally provided at the distal end of an inner tube 23A or 61A of a feed tube 23 or 61 in the foregoing embodiments, the present invention is not restricted to this particular arrangement. For example, a separately formed flange member may be bonded or fitted on the inner tube, or alternatively the flange portion may be abolished if desired.

Furthermore, instead of providing four notches 65 at angular intervals of 90° around the circumference of the flange portion 64 as in the above-described third embodiment, there may be provided two, three or more than five notches, if desired. There is no restriction in particular with regard to the number, shape and size of the notches. Namely, the size, shape and number of the notches 65 should be determined suitably in relation with thinner discharge rate and thinner distribution rates to various parts of the rotary atomizing head.

INDUSTRIAL APPLICABILITY

As clear from the foregoing detailed description, according to the present invention, by the action of assist air which is spurted out through the assist air outlet holes, a solvent which has come out through the respective solvent passages can be guided toward the fore end of the bell cup, thereby preventing the solvent from being scattered away in radially outward directions under the influence of centrifugal force resulting from high speed rotation of the rotary atomizing head. As a consequence of suppression of scattering, it becomes possible to bring the solvent into intimate contact with the outer peripheral surface of the bell cup, that is to say, to wash away deposited paint from the outer peripheral surface by the use of a smaller quantity of solvent and in a more reliable manner, thereby permitting to suppress consumption of the solvent to a minimum necessary amount and at the same time to improve washing efficiency through reduction of washing time.

In this instance, by cooperative actions of assist air which is spurted out through the assist air outlet holes and shaping air which is spurted out through the shaping air outlet holes, the solvent which flows out through the respective solvent passages can be pushed against the outer peripheral surface of the bell cup and guided toward the fore end of the bell cup against the centrifugal force resulting from high speed rotation of the rotary atomizing head. This makes it possible to suppress scattering of the solvent toward the outer peripheral side and wash away deposited paint efficiently from the outer peripheral surface of the bell cup.

We claim:

1. A rotary atomizing head coating machine, including a cover of cylindrical shape, an air motor provided within said cover, a rotational shaft provided axially in and rotated by said air motor, a rotary atomizing head and a feed tube provided axially in said rotational shaft and having a fore end portion for spouting paint or solvent, said rotary atomizing head coating machine comprising:

a rotary atomizing head mounted on said rotational shaft for high speed rotation and including a bell cup of bell- or cup-like shape, a hub member mounted on the inner peripheral side of said bell cup and defining a paint reservoir on and together with said bell cup for temporarily storing paint spouted through said feed tube, a plurality of paint outlet holes provided in said hub member to let paint or solvent supplied to said paint reservoir through said feed tube flow out from said paint reservoir onto fore inner peripheral surface of said bell cup, and a plurality of solvent passages provided in said bell cup to let a solvent supplied to said paint reservoir through said feed tube flow out from said paint reservoir onto outer peripheral surface of said bell cup;

a plurality of assist air outlet holes provided in front end portions of said cover to spurt assist air for guiding said solvent toward the front end of said bell cup upon coming out onto outer peripheral side of said bell cup through said plurality of solvent passages; and a plurality of shaping air outlet holes provided in front end portions of said cover radially on the outer side of said plurality of assist air outlet holes.

2. A rotary atomizing head coating machine as defined in claim 1, further comprising an annular barrier groove provided on the outer peripheral surface of said bell cup for temporarily storing effluent solvent from said plurality of solvent passages.

3. A rotary atomizing head coating machine as defined in claim 1, wherein said cover is internally provided with an assist air passage to deliver assist air supplied from a pressurized air source, and an exhaust air passage to deliver exhaust air from said air motor, air from said assist air passage and exhaust air passage being joined together and spurted out through said plurality of assist air outlet holes.

4. A rotary atomizing head coating machine as defined in claim 3, wherein a plug is detachably attached to said exhaust air passage for selectively bringing said exhaust air passage into and out of communication with said plurality of assist air passage.

5. A rotary atomizing head coating machine as defined in claim 3, further comprising an assist air controlling device configured to control at least one of a flow rate of said assist air and a pressure of said assist air, said assist air controlling device being provided between said assist air passage and said pressurized air source.

6. A rotary atomizing head coating machine as defined in claim 1, further comprising a flange portion formed around the fore end of said feed tube for diffusing distribution of solvent spouted through said feed tube.

7. A rotary atomizing head coating machine as defined in claim 6, wherein said flange portion is provided with a plurality of notches at intervals around the circumference thereof.

8. A rotary atomizing head coating machine as defined in claim 1, further comprising an annular guide member provided around the outer peripheral surface of said bell cup in predetermined spaced relation with the bell cup to form therebetween a solvent diffusing chamber for diffused distribution of said solvent coming out of said plurality of solvent passages.

9. A rotary atomizing head coating machine as defined in claim 8, further comprising an annular protuberance provided within said solvent diffusing chamber for distributing flow of said solvent around the entire outer periphery of said bell cup.

10. A rotary atomizing head coating machine as defined in claim 6, further comprising an annular guide member provided around the outer peripheral surface of said bell cup in predetermined spaced relation with the bell cup to form therebetween a solvent diffusing chamber for diffused distribution of said solvent coming out of said plurality of solvent passages.

11. A rotary atomizing head coating machine as defined in claim 6, further comprising an annular barrier groove provided on the outer peripheral surface of said bell cup for temporarily storing effluent solvent from said plurality of solvent passages.

12. A rotary atomizing head coating machine, including an air motor, a rotational shaft provided axially in and rotated by said air motor, and a feed tube provided axially in said rotational shaft and having a fore end portion for spouting paint or solvent, said rotary atomizing head coating machine comprising:

a rotary atomizing head mounted on said rotational shaft for high speed rotation and including a bell cup of bell- or cup-like shape, a hub member mounted on the inner peripheral side of said bell cup and defining a paint reservoir on and together with said bell cup for temporarily storing paint spouted through said feed tube, a plurality of paint outlet holes provided in said hub member to let paint or solvent supplied to said paint reservoir through said feed tube flow out from said paint reservoir onto fore inner peripheral surface of said bell cup, and a plurality of solvent passages provided in said bell cup to let a solvent supplied to said paint reservoir through said feed tube flow out from said paint reservoir onto outer peripheral surface of said bell cup;

a plurality of assist air outlet holes provided in front end portions of said cover to spurt assist air for guiding said solvent toward the front end of said bell cup upon coming out onto outer peripheral side of said bell cup through said plurality of solvent passages; and a cover of cylindrical shape internally provided with an assist air passage to deliver assist air supplied from a pressurized air source, and an exhaust air passage to deliver exhaust air from said air motor, air from said assist air passage and exhaust air passage being joined together and spurted out through said plurality of assist air outlet holes.

13. A rotary atomizing head coating machine, including a cover of cylindrical shape, an air motor provided within said cover, a rotational shaft provided axially in and rotated by said air motor, and a feed tube provided axially in said rotational shaft and having a fore end portion for spouting paint or solvent, said rotary atomizing head coating machine comprising:

a rotary atomizing head mounted on said rotational shaft for high speed rotation and including a bell cup of bell- or cup-like shape, a hub member mounted on the inner peripheral side of said bell cup and defining a paint reservoir on and together with said bell cup for temporarily storing paint spouted through said feed tube, a plurality of paint outlet holes provided in said hub member to let paint or solvent supplied to said paint reservoir through said feed tube flow out from said paint reservoir onto fore inner peripheral surface of said bell cup, and a plurality of solvent passages provided in said bell cup to let a solvent supplied to said paint reservoir through said feed tube flow out from said paint reservoir onto outer peripheral surface of said bell cup;

a plurality of assist air outlet holes provided in front end portions of said cover to spurt assist air for guiding said solvent toward the front end of said bell cup upon coming out onto outer peripheral side of said bell cup through said plurality of solvent passages; and a flange portion formed around the fore end of said feed tube for diffusing distribution of solvent spouted through said feed tube, wherein said flange portion is provided with a plurality of notches at intervals around the circumference thereof.

14. A rotary atomizing head coating machine, including a cover of cylindrical shape, an air motor provided within said cover, a rotational shaft provided axially in and rotated by said air motor, and a feed tube provided axially in said rotational shaft and having a fore end portion for spouting paint or solvent, said rotary atomizing head coating machine comprising:

a rotary atomizing head mounted on said rotational shaft for high speed rotation and including a bell cup of bell- or cup-like shape, a hub member mounted on the inner peripheral side of said bell cup and defining a paint reservoir on and together with said bell cup for temporarily storing paint spouted through said feed tube, a plurality of paint outlet holes provided in said hub member to let paint or solvent supplied to said paint reservoir through said feed tube flow out from said paint reservoir onto fore inner peripheral surface of said bell cup, and a plurality of solvent passages provided in said bell cup to let a solvent supplied to said paint reservoir through said feed tube flow out from said paint reservoir onto outer peripheral surface of said bell cup;

a plurality of assist air outlet holes provided in front end portions of said cover to spurt assist air for guiding said solvent toward the front end of said bell cup upon coming out onto outer peripheral side of said bell cup through said plurality of solvent passages; and an annular guide member provided around the outer peripheral surface of said bell cup in predetermined spaced relation with the bell cup to form therebetween a solvent diffusing chamber for diffused distribution of said solvent coming out of said plurality of solvent passages.

15. A rotary atomizing head coating machine as defined in claim 14, further comprising an annular protuberance provided within said solvent diffusing chamber for distributing flow of said solvent around the entire outer periphery of said bell cup.

* * * * *